US007812540B2

(12) United States Patent
Ponard et al.

(10) Patent No.: US 7,812,540 B2
(45) Date of Patent: Oct. 12, 2010

(54) METHOD FOR MAKING ELECTRODES AND VACUUM TUBE USING SAME

(75) Inventors: Pascal Ponard, Neuvecelle (FR); Marc Ferrato, Horgues (FR)

(73) Assignee: Thales (FR)

( * ) Notice: Subject to any disclaimer, the term of this patent is extended or adjusted under 35 U.S.C. 154(b) by 126 days.

(21) Appl. No.: 10/498,498

(22) PCT Filed: Dec. 10, 2002

(86) PCT No.: PCT/FR02/04272

§ 371 (c)(1),
(2), (4) Date: Jun. 14, 2004

(87) PCT Pub. No.: WO03/054900

PCT Pub. Date: Jul. 3, 2003

(65) Prior Publication Data

US 2005/0130550 A1 Jun. 16, 2005

(30) Foreign Application Priority Data

Dec. 20, 2001 (FR) ..... 01 16562

(51) Int. Cl.
*H01J 25/34* (2006.01)

(52) U.S. Cl. ..... 315/3.5; 315/5.38; 315/39.3

(58) Field of Classification Search ..... 315/3.5, 315/1, 5.33, 5.38, 39.3, 84.61, 500; 445/23, 445/35, 39, 46, 49, 67; 313/311, 495
See application file for complete search history.

(56) References Cited

U.S. PATENT DOCUMENTS 3,662,212 A * 5/1972 Rawls, Jr. ..... 315/3.5
3,761,761 A * 9/1973 Van Oostrom ..... 313/311
3,806,755 A * 4/1974 Lien et al. ..... 315/5.38
3,995,193 A * 11/1976 Horigome et al. ..... 315/5.38
4,107,574 A * 8/1978 Ruf et al. ..... 315/3.5
4,277,721 A 7/1981 Kosmahl
4,504,762 A * 3/1985 Hart et al. ..... 313/30
4,527,092 A * 7/1985 Ebihara ..... 315/5.38
4,734,915 A * 3/1988 Mefferd et al. ..... 372/61
4,736,379 A * 4/1988 Barker et al. ..... 372/34
5,025,193 A * 6/1991 James ..... 315/5.38
5,153,901 A * 10/1992 Shoulders ..... 378/119
5,227,694 A * 7/1993 Wertman ..... 315/5.38
5,436,525 A * 7/1995 Theiss ..... 315/5.38
5,644,131 A * 7/1997 Hansen ..... 250/292
5,721,561 A * 2/1998 Kishino et al. ..... 345/75.2
5,729,583 A * 3/1998 Tang et al. ..... 378/122
5,777,543 A * 7/1998 Aida et al. ..... 338/308
5,798,604 A * 8/1998 Duboc et al. ..... 313/495
5,841,221 A * 11/1998 Griggs ..... 313/326
5,955,392 A * 9/1999 Takeuchi et al. ..... 501/103
6,044,129 A * 3/2000 Miller et al. ..... 378/125

(Continued)

*Primary Examiner*—Douglas W Owens
*Assistant Examiner*—Tung X Le
(74) *Attorney, Agent, or Firm*—Lowe Hauptman Ham & Berner, LLP

(57) ABSTRACT

The invention relates to vacuum tubes and especially to electron tubes. To produce the tube, and especially an electron collector comprising several electrodes, the electrodes are produced in the form of blocks of ceramic having a high thermal conductivity. The blocks are electrically conducting (at least on the surface). They are preferably made of an insulating ceramic such as aluminium nitride, and are made conductive over part of their surface. The conductive surface part is preferably formed by a conductive ceramic, preferably based on titanium nitride, or on similar conductive ceramic materials. Thus, increased strength, better heat dissipation and weight reduction are achieved.

11 Claims, 5 Drawing Sheets

U.S. PATENT DOCUMENTS

| | | | | |
|---|---|---|---|---|
| 6,163,112 | A | 12/2000 | Ponard et al. | 315/5.47 |
| 6,208,079 | B1 * | 3/2001 | Brown, II | 315/3.5 |
| 2001/0024078 | A1 * | 9/2001 | Dimitrijevic et al. | 313/311 |
| 2002/0008478 | A1 * | 1/2002 | Schult | 315/5.37 |
| 2002/0185974 | A1 * | 12/2002 | Nakano et al. | 313/623 |
| 2003/0051665 | A1 * | 3/2003 | Zhao et al. | 118/723 E |

* cited by examiner

METHOD FOR MAKING ELECTRODES AND VACUUM TUBE USING SAME

FIELD OF THE INVENTION

The invention relates to a process for manufacturing electrodes, this being mainly designed for the production of vacuum electron tubes and especially tubes using an electron collector; the collector collects the electrons after a fraction of the energy that has been communicated to them by an accelerating electric field created in the vacuum tube has been used. This manufacturing process can be used for the production of electrodes other than collectors for electron tubes. More generally, it is applicable to the production of electrodes for all kinds of total or partial vacuum devices that involve, in this vacuum, a physical transport of charged elementary particles (electrons, but also ions) that can be accelerated, or slowed down or collected by electrodes of the device. However, the process will be described with regard to the most useful application, which is the production of the collector of a linear-beam vacuum electron tube.

As examples of linear-beam tubes, mention may be made of single-beam or multibeam klystrons, travelling wave tubes, carcinotrons and IOTs (inductive output tubes).

These tubes generally operate by making an electromagnetic wave and a linear electron beam interact in a region called the interaction region, the beam communicating some of its kinetic energy to the electromagnetic wave in order to amplify it. In general, the beam still retains some of its kinetic energy after it has passed through the interaction region and it is necessary to collect the residual electrons in a collector placed at the outlet of the interaction region. Sometimes the kinetic energy remaining downstream of the interaction region may reach 50% to 80% of the energy initially communicated to the beam upstream of this region. It follows that there are major constraints on producing the collector in terms of heat dissipation; there are also other constraints, such as the voltage withstand, etc.

BACKGROUND OF THE INVENTION

In the past, the collector consisted of a simple metal electrode, usually made of copper, raised to an appropriate potential (usually that of the anode, which served to accelerate the electrons). However, to increase the efficiency of the tubes it was necessary to produce more sophisticated collectors, called monostage or multistage depressed collectors, formed by several successive electrodes raised to different potentials and therefore electrically insulated from one another.

The production of such collector electrodes poses various problems, these being all the more difficult to solve when the tubes have to be both increasingly powerful and increasingly compact. Among such problems there is the problem of removing the heat produced by the impact of the electrons on an electrode and the problem of secondary electron emission at the electrodes; there is the problem of electrically insulating the electrodes from one another and from the outside; there is the problem of vacuum-sealing the tube, with the related problem of the feed-through of electrical connections from the inside to the outside of the tube in order to take a current or voltage from an internal electrode to the outside of the tube or from the outside to an internal electrode in the tube, and this applies for each of the electrodes of the collector, and also likewise in the case of the other electrodes of the tube (the anode and the cathode).

The solutions adopted for producing these depressed collectors very often use copper electrodes brazed to or shrunk onto parts made of insulating ceramics; the ceramic provides the electrical insulation between electrodes raised to different potentials and in the case of a collector with internal electrical insulations, the ceramic must also transfer the heat flux. The braze provides the mechanical integrity and the vacuum-tightness. These assemblies are complex and costly. Their heterogeneous structure, consisting of ceramics and metal, makes them particularly sensitive to vibrations and thermo-mechanical stresses. Their performance characteristics are limited, especially as regards efficiency of heat dissipation, permissible operating voltages, compactness, and also sometimes weight (for example for space applications of tubes).

The problems are particularly difficult when producing a multistage collector, but it will be understood that these problems may also exist in the case of insulated electrodes for which it is also necessary to provide, on the one hand, electrical insulation with respect to the rest of the tube and, on the other hand, a voltage or current supply, and finally removal of the heat produced.

The object of the present invention is in particular to produce a tube of improved construction in terms of relationship between the performance obtained and the manufacturing cost.

To do this, the invention proposes, on the one hand, an electron tube having electrodes of novel construction and, on the other hand, a process for manufacturing such a tube.

SUMMARY OF THE INVENTION

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

The vacuum electron tube according to the invention includes at least one electrode (preferably a collector electrode) that is characterized in that it comprises a block composed mainly of ceramic having a high thermal conductivity, this block of ceramic being, at least on the surface, electrically conductive (at least in certain regions).

This block can be made of a ceramic that is electrically conductive through its thickness. In this case, it would be cosintered (or if necessary brazed) with other blocks of electrically insulating ceramic in order to provide the electrical insulation between the electrode and other parts of the tube. However, it is preferable, in order to avoid problems of integrity of the bond between two blocks of different ceramics, one being insulating and the other conductive, to produce the electrode in the form of a block of electrically insulating ceramic, only the surface of which is locally rendered electrically conductive.

The feature of these electrodes of the vacuum tube according to the invention is therefore that they are made in the form of blocks of ceramic and not metal blocks.

Ceramics are refractory mineral compounds, such as metal oxides, metal nitrides and metal carbides, which are treated by sintering, that is to say by agglomeration at high temperature (and possibly under pressure) of a powder of the compound or of a paste of the compound (the paste being a powder mixed with an organic binder, the latter disappearing during the agglomeration operation). Certain ceramics are electrically insulating, while others are conductive, depending on the nature of the mineral compounds which make up the said ceramics. By mixing insulating compounds and electrically conductive compounds, the ceramics may also have intermediate conductivities.

In one advantageous embodiment, the electrode is produced in the form of a block of electrically insulating ceramic, with a high thermal conductivity, locally covering a thin layer of electrically conductive ceramic; the electrode is produced by cosintering the two ceramics. Consequently, in this case, electrically conductive regions are as it were drawn as a relatively thin layer (the order of magnitude of the thickness is, for example, around 100 microns) on the surface of a block of insulating ceramic; the electrode (or even a group of several separate electrodes) is formed by the block thus locally rendered conductive on the surface.

The electrode is therefore produced in this case in the form of a block of composite ceramic (with two different compositions, one being conductive and the other insulating, but both being made of ceramic) and not in the form a metal electrode (copper) brazed onto an insulating ceramic (alumina), as could be done in the prior art.

The electrically conductive surface part of the ceramic electrode could be made of a refractory metal such as tungsten or molybdenum cosintered as a thin layer on a block of insulating ceramic.

This arrangement is all the more advantageous when the ceramic (and especially that of which the insulating block is composed) has a high thermal conductivity. The expression "ceramic with a high thermal conductivity" is understood to mean a ceramic whose thermal conductivity coefficient is at least 100 watts/m·K at 20° C., which represents about one quarter of the conductivity of copper, but at least about three times the conductivity of alumina.

The electrode made of ceramic in this way may contribute directly to the vacuum-tightness of the tube if it constitutes directly a part of the wall of the tube's envelope. However, it may also be cosintered with another, insulating ceramic constituting (partly or completely) the vacuum envelope of the tube. For example, the electrodes are blocks of ceramic (that are electrically conductive at least on the surface) which are inserted into a sheath of insulating ceramic and cosintered with this sheath. The sheath then constitutes the vacuum envelope of the tube.

To connect the electrode to the outside of the tube, it will also be preferable to use a pin made of a conductive ceramic; this pin is in contact on one side with part of the conductive ceramic of the electrode, inside the tube, and it passes through an insulating ceramic forming part of the electrode and/or of the envelope of the tube, and cosintered with this insulating ceramic.

The vacuum-tightness of these conducting feedthroughs is excellent as, on the one hand, the bond obtained by high-temperature heat treatment is strong and, on the other hand, the alloyed materials exhibit similar thermomechanical behaviour. This is particularly true when the feedthrough is made by the cosintering of ceramics. However, the feedthroughs may also be made of a refractory metal cosintered with the ceramic while the latter is being sintered.

Thanks to this way of producing an electrode in the form of a block of highly heat-conductive ceramic, it is possible to adopt tube arrangements that are particularly effective from the standpoint of heat removal, inter-electrode insulation, and compactness and weight of the tube, which arrangements could not be adopted with conventional metal electrodes or with conventionally brazed ceramic/metal assemblies.

The conductive ceramic produced as a solid block or as a thin layer may especially be made of silicon carbide or titanium carbide or tungsten carbide or titanium nitride, or a mixture of two or more of these materials. It may also include additives consisting of compounds that facilitate the sintering operation, such as for example yttrium oxide, the presence of additives being conventional in the sintering of ceramics.

The ceramic used to produce a block of insulating ceramic forming part of the electrode or of the envelope of the tube is preferably based essentially on aluminium nitride, this material having a very high thermal conductivity (about 180 watts/m·K at 20° C.) and a very high dielectric strength (it withstands electric fields of at least 20 kV/mm). It may be made of almost pure aluminium nitride or of a composite ceramic comprising aluminium nitride cosintered with silicon carbide or titanium nitride in small proportion in the aluminium nitride. Here again, sintering additives may be present.

As indicated above, the present invention provides not only a tube of novel construction but also a novel manufacturing process that is particularly suitable for the production of electron tubes and especially tubes with an electron collector or more generally any electrode system. This process consists in producing at least one electrode of the tube by cosintering an electrically conductive ceramic onto an electrically insulating ceramic having a high thermal conductivity. The conductive ceramic preferably consists of a relatively thin layer deposited on part of the surface of the insulating ceramic, but it may also be produced in bulk form, and in this case the conductive ceramic also preferably has a high thermal conductivity. In both cases, the insulating ceramic serves as substrate for the layer of electrically conductive ceramic, with very good thermal and mechanical properties of the assembly thus formed, owing to the homogeneity in the nature (ceramic) of the materials used.

If it is desired to produce a conducting feedthrough starting from the conductive ceramic and passing through a thickness of the insulating ceramic (whether or not the latter forms part of an envelope of an electron tube), the block of insulating ceramic is drilled before the cosintering operation and a conductive rod (which preferably is also made of a conductive ceramic but which may optionally be made of a refractory metal) is introduced into the drillhole, bringing it into contact on one side with the conductive ceramic. The sintering operation is then carried out afterwards. This operation seals, at very high temperature, the rod into the insulating block through which it passes and constitutes a feedthrough that can be both vacuum-tight and very resistant to thermomechanical stresses.

The invention is applicable to vacuum tubes (whether partial or complete vacuum). The main application is the application to electron tubes, i.e. tubes in which the charged particles that are transported are electrons (in this case, the vacuum is generally a very high vacuum). Another possible application is a device (which will also be referred to by the name "tube" in order to simplify matters) in which the transported particles are not electrons but ions. For example, the invention may be applied to the production of the accelerating electrodes for an ion motor; an ion motor is a motor whose action is intended to move an object in a vacuum (for a satellite or a space craft); when it is operating, it produces, continuously, a plasma of charged ions that are accelerated in a partial vacuum by an electric field (by means of electrodes) and are ejected through a nozzle. The ejection acts as a conventional jet engine, the difference being that the ejected material is ionic (charged) and that it is ejected through the effect of acceleration by an electric field acting directly on the ions on account of their charge. In this patent application, and especially in the claims, the term "tube" will be considered to encompass all devices with electrodes using the transport of charged particles in a complete (i.e. very high) vacuum or a partial (less high) vacuum, whether the tube is open or partly open (as in the case of a motor).

It should be noted that the suggestion was made in U.S. Pat. No. 4,277,721 to produce electrodes whose surfaces have characteristics that minimize secondary emission thanks to coatings of materials such as pyrolytic graphite, titanium carbide, tungsten carbide or titanium diboride. The thermal conductivity of these materials is not mentioned, and they are in principle deposited on electrodes that are conventionally made of copper.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

Other features and advantages of the invention will become apparent on reading the detailed description that follows, given with reference to the appended drawings in which.

DETAILED DESCRIPTION OF THE EMBODIMENT

Figure 1:
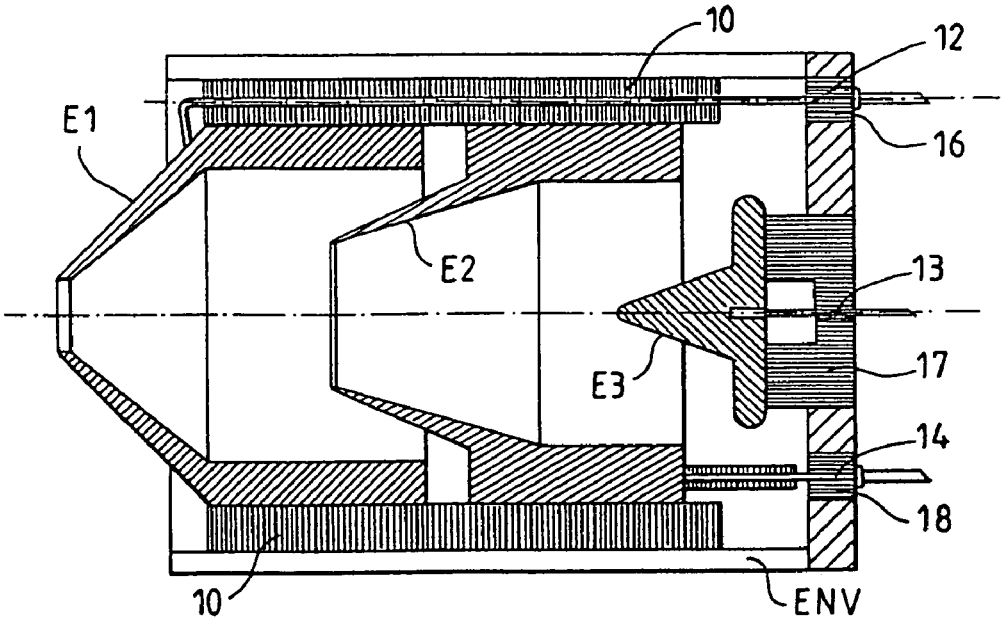
FIGS. 1 and 2 show collector constructions for a vacuum tubes of the prior art.

The invention will be described with regard to the production of the collector of a travelling-wave electron tube with a multistage depressed collector, but it is applicable in many other cases, namely vacuum electron tubes other than a TWT, with a non-depressed collector and a single electrode, and electrodes other than collector electrodes. However, it is particularly advantageous in the case of a multistage depressed collector and this is the reason why this example was chosen to be described in detailed. Likewise, with regard to the manufacturing process according to the invention, which will be described with regard to the same travelling-wave tube, it shall be understood that it is applicable to the production of a TWT collector just as to the production of other electrodes for tubes, with the overall meaning given above for the word "tube".

It will be recalled that a TWT (travelling-wave tube) is a vacuum tube comprising a cathode, which emits a linear electron beam (focused by permanent magnets), and, in succession from the upstream to the downstream in the direction of travel of the electrons: an anode for accelerating these electrons; a radiofrequency signal input that receives a radiofrequency signal to be amplified, this input being connected to the input of a decelerating structure, which is for example a helix surrounding the electrons beam; an outlet of the decelerating structure, constituting the output of the TWT, which delivers a radiofrequency signal; and a collector for collecting the electrons of the beam downstream of the decelerating structure. These electrons have lost some of their energy by communicating it to the radiofrequency wave, in the interaction region located between the upstream part and the downstream part of the helix. The collector that receives the electrons is subjected to intense heating due to the impact energy of the electrons and it is this heating that is one of the main causes of difficulties in producing the tube.

The collector is typically a multistage depressed collector, i.e. one having several electrodes raised to different potentials and insulated from one another by electrically insulating parts. The potentials are chosen in such a way that the electrons having a certain energy reach if possible the electrode that is at a potential corresponding approximately to this energy. In this way, a high tube efficiency is obtained, but this means that several electrodes must be connected to the outside of the tube.

All the elements that have just been described are enclosed inside a vacuum envelope in which a high vacuum is created. The envelope has insulating parts and possibly also conducting parts. Some of the elements described above—electrodes or insulators between electrodes—may themselves form part of the vacuum envelope and therefore themselves are vacuum-tight. The welds or brazed joints between elements, for example between a metal electrode and an insulating ceramic, also contribute to this vacuum-tightness. Finally, when an electrode is located completely inside the envelope (that is to say it does not constitute part of the external envelope and is therefore not directly accessible from the outside), it is generally necessary to provide a conducting feedthrough in order to connect it to the outside through an insulating part of the envelope, in order to connect the envelope to an external pin.

FIG. 1 shows an illustrative example of a multistage depressed collector with internal insulation of the prior art, which allows the differences provided by the invention in the overall construction of the collector to be better understood.

The collector, generally cylindrical in shape, comprises, in this example, three bulk copper electrodes E1, E2, E3 having conical shapes, the apex of which, open in the case of the first two electrodes and closed in the case of the third, is turned towards the electron entry side (on the left in FIG. 1). The electrodes E1 and E2 also have a cylindrical part gripped by bars (or plates) 10 of insulating ceramic, which are themselves contained in an outer metal envelope ENV constituting both a cover for electromagnetic protection and a vacuum envelope. The insulating ceramic is in general alumina for the low power levels to be dissipated and beryllium oxide BeO in the case of higher power levels. On the right, the collector is closed by an assembly of insulating parts and of conducting parts that are brazed together, also contributing to the vacuum-tightness. Conducting feedthroughs are provided for connecting the electrodes E1, E2, E3 to the outside. These feedthroughs comprise a conductor 12, 13 or 14 surrounded by insulating ceramic 16, 17 or 18. In the example shown in FIG. 1, the ceramic bars 10 that surround the electrodes E1 and E2 also serve for taking a conductor of the electrode E1 to the end wall of the collector, up to the conducting feedthrough 12, and insulating this conductor from the electrode E2 and from the outer envelope ENV.

Figure 2:
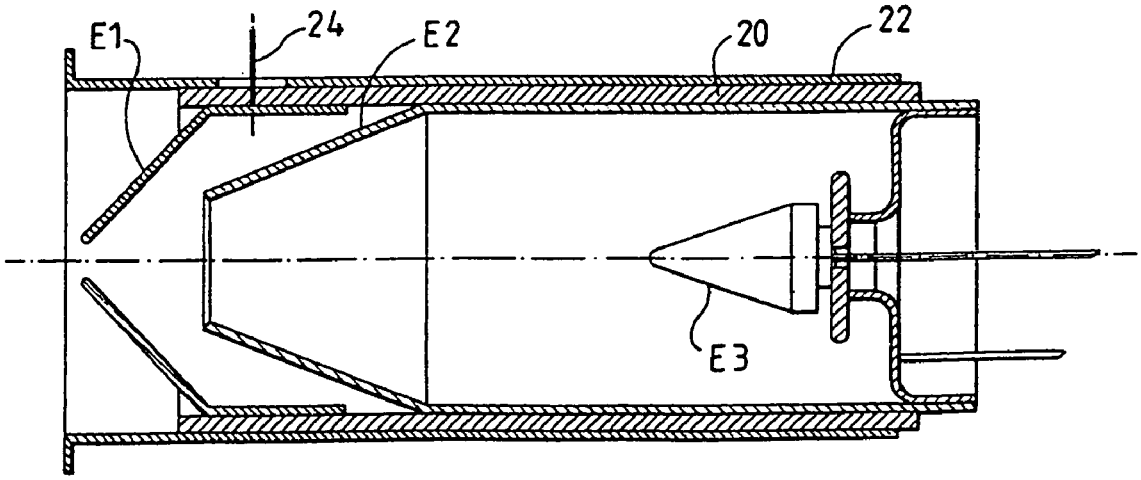

FIG. 2 shows another illustrative example of a TWT collector, in which the electrodes are less bulky than in FIG. 1. They are bodies of revolution, made of thin copper brazed over their entire cylindrical periphery to the inside of a ceramic sheath 20; the resistance of this structure to thermal stresses is possible only if the thinness of the electrodes allows the differential expansions to be accommodated without extensive strain. Here again, the ceramic sheath is surrounded by another, metal sheath 22 serving as a cover for electromagnetic protection. Vacuum-tightness is provided both by metal parts and by insulating ceramic parts. FIG. 2 shows that conducting feedthroughs 24 may be provided radially through the insulating sheaths in order to connect the electrode E1 to the outside of the vacuum tube. A metal conductor, such as nickel brazed to the internal electrode E1, is used. Vacuum-tightness is provided by brazing onto the ceramic sheath. For connecting the electrode E2, the electrode itself is taken out through the end wall of the tube as far as the outside, and this electrode E2 therefore contributes directly to vacuum-tightness. In the case of the electrode E3, a complex assembly consisting of metal, insulating ceramic and conducting feedthrough must be provided in order to make the connection to the outside through the end wall of the tube.

In both cases, these figures show the complexity of the assembly for withstanding the mechanical stresses, electrical stresses and thermal stresses.

Figure 3:
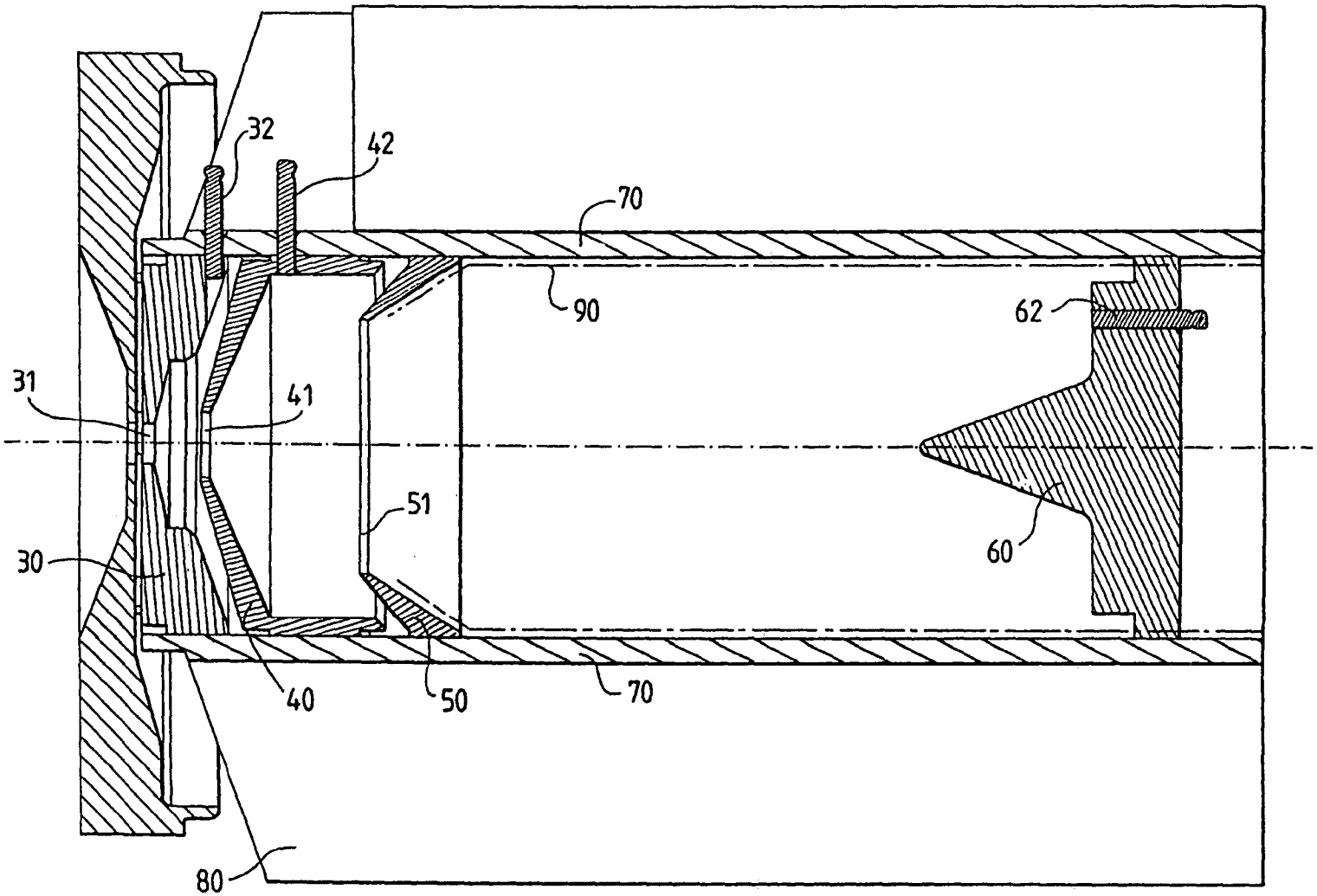
FIG. 3 shows, in section, a tube collector according to the invention.

FIG. 3 shows the general principle of the construction of a tube according to the invention with a collector, the feature of which is that at least some of the electrodes (but preferably all of them) are made mainly of ceramic. They are each formed from a block of ceramic (similar to the copper blocks of FIG. 1)—this ceramic is conductive, at least on the surface (in order to produce the electron-collecting function of the electrode) and has very good thermal conduction properties in order to remove the heat generated by the impact of the electrons.

Preferably, each electrode is formed from a thin layer of conductive ceramic sintered onto the surface of an insulating ceramic. In this case, it is the electrically insulating ceramic that has to have very good thermal conduction properties.

The preferred construction of the collector is as follows: the blocks of ceramic constituting the various electrodes are placed in contact with the inner periphery of a sheath of insulating ceramic.

Conducting feedthroughs are preferably provided in this sheath in order to provide electrical connection between the outside of the tube and the conducting part of at least some of the ceramic electrodes.

The electrodes, the insulating sheath and the conducting feedthroughs are preferably fastened together in a single heat-treatment operation (cosintering) or else several successive heat treatments which provide strong bonding and therefore vacuum-tightness inside the vacuum tube.

FIG. 3 shows a collector that has four electrodes, these being, respectively, along the direction of travel of the electrons, a first electrode 30, a second electrode 40, a third electrode 50 and a final electrode 60. The first three electrodes are drilled axially along their centre, in order to let the electron beam through, with openings (respectively 31, 41, 51) of increasing width in order to take account of the increasing divergence of the beam towards the downstream end. The final electrode 60 is not drilled.

The electrodes are made of an electrically conductive ceramic in certain regions, on the surface, and electrically insulating in the bulk. The ceramic may be conductive over its entire surface or only in regions drawn in a pattern that depends of course on the general design of the tube, the rest of the electrode being formed by a block of insulating ceramic.

The four electrodes are preferably mounted in a cylindrical sheath 70 made of a ceramic that is electrically insulating and highly heat-conducting. This cylindrical sheath 70 constitutes the outer envelope of the tube and it is preferably provided with radial fins 80 which help to remove the heat generated inside the tube during operation. This sheath 70, like the electrodes 30, 40, 50 and 60, may have a locally conducting surface, both on the inside and on the outside of the tube. In practice, it will be seen that the sheath may constitute an electrode (its internal surface only) at the same potential as the electrode 50.

The end wall of the tube, on the right in FIG. 3, may be formed completely by the mass of the final electrode 60, in particular if this is only conductive in its surface part inside the tube.

The conducting regions of each electrode have not been shown in FIG. 3. However, to illustrate the principle of the invention, a dashed line 90, along the inner wall of the sheath 70 and along part of the electrode 50, depicts a surface region that is conducting.

The electrical connection of the various electrodes with the outside, in order to carry bias voltages or currents, is made in the following manner. In the case of the electrode 30, a radial conducting feedthrough is provided through the insulating cylindrical sheath 70. The feedthrough comprises a conducting rod 32 that passes through a drillhole in the electrode 30 and a corresponding drillhole in the sheath 70. The conducting rod 32 is preferably made of a conductive ceramic, but it could also be made of a refractory conducting metal such as tungsten. It comes into contact, inside the tube, with a conducting region of the first electrode 30.

In the case of the second electrode 40, the arrangement is very similar, with a radial conducting feedthrough comprising a conducting rod 42.

As regards the third electrode 50, it would have been possible also to provide a conducting feedthrough, but in this example provision is made for the inner surface of the sheath 70 to be made conducting in the same way as the conducting surface of the electrodes, i.e. preferably by cosintering a conductive ceramic onto an insulating ceramic. The conducting region is depicted by the dashed line 90 already mentioned. Conducting electrical continuity may thus be established from the electrode 50 right to the outside of the tube, as shown by the dashed line 90 that goes from the electrode 50 to beyond the electrode 60. The conducting part outside the tube can then constitute an external connection for the third electrode 50. For this reason, it may be considered that the sheath itself constitutes an electrode, at the same potential as the electrode 50.

The connection of the final electrode 60 with the outside may also be made through the end wall of the tube, either by direct contact with the ceramic, if its external face is conducting and in electrically conducting contact with its face on the inside of the tube or else if it is entirely made of conductive ceramic, or by a conducting feedthrough, with a rod 62, from the inner face of the electrode right to the outside of the tube if only the surface of the ceramic inside the tube is conducting. The feedthrough in this case passes through the block of insulating ceramic constituting the electrode 60 and not through the sheath 70. The feedthrough runs axially and not radially.

The entire collector is therefore formed from ceramics, certain parts being made of electrically insulating ceramic but of very high thermal conductivity, and other parts being made of electrically conductive ceramic and connected to conducting rods passing through the insulating ceramic. What is therefore obtained is a collector block whose parts have homogeneous thermomechanical properties.

It is advantageous to produce the entire collector by the cosintering of ceramics, that is to say by mounting the electrodes and the sheath in place, one with respect to another, while these pieces are still in the green state of ceramics, and by carrying out the sintering operation on all the ceramics at the same time. However, it is also possible to strongly bond the electrodes to the body by successive heat treatments or else to carry out partial cosintering operations on certain subassemblies and then combine the subassemblies together with or without another sintering operation.

Figure 4:
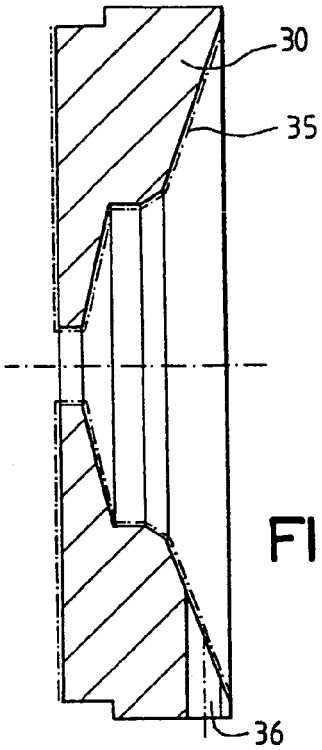
FIGS. 4 to 7 show the various separate ceramic electrodes.

FIG. 4 shows just the first electrode 30. In this illustrative example, the electrode is surface-conducting over almost its entire area, but excluding its periphery. It will also be contact around its periphery with the sheath 70. The electrode is made by machining a green paste of insulating ceramic.

The machined electrode is coated with a thin layer of green conductive ceramic 35 depicted by the dashed line. The delimitation of the conducting region may be achieved either by masking of the regions that have to remain insulating or by selective removal after uniform deposition on all the surfaces. The electrode 30 may be sintered prior to its insertion into the sheath 70, or else inserted firstly into the sheath 70 and then cosintered with the sheath. If it is sintered at the same time as the sheath, the mechanical bond between the electrode and the sheath will only be stronger and the thermal conductivity improved. The conducting feedthrough for connecting the electrode to the sheath is produced by making a radial drillhole 36 into which the conducting rod 32 seen in FIG. 3 can be inserted; this rod will preferably be placed in the drillhole before a cosintering of the electrode and the sheath. It is in contact on one side with the layer of conductive ceramic 35. The sintering operation makes the surface conductive ceramic 35 adhere to the insulating ceramic that forms the body of the electrode 30.

Figure 5:
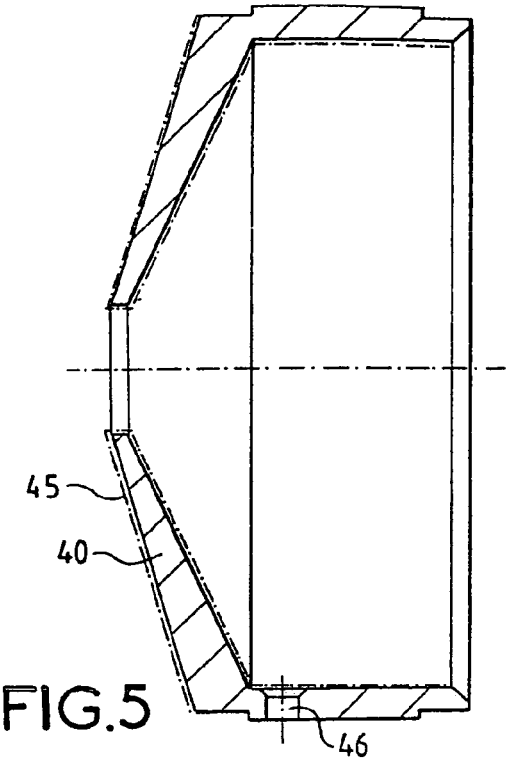

FIG. 5 shows just the second electrode 40 individually. It is formed in principle in the same way as the first, namely by sintering a green, electrically insulating, ceramic body having the shape of the desired electrode, partly coated with a thin layer of green conductive ceramic 45. A drillhole 46 serves for passage of a rod 42 for establishing the conducting feedthrough.

Figure 6:
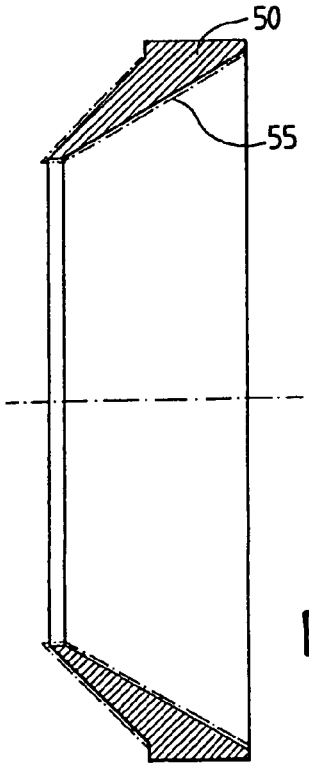

FIG. 6 shows just the third electrode 50, consisting like the other ones with a local surface layer 55 of conductive ceramic, but no drillhole if no conducting feedthrough for its connection to the outside is provided.

Figure 7:
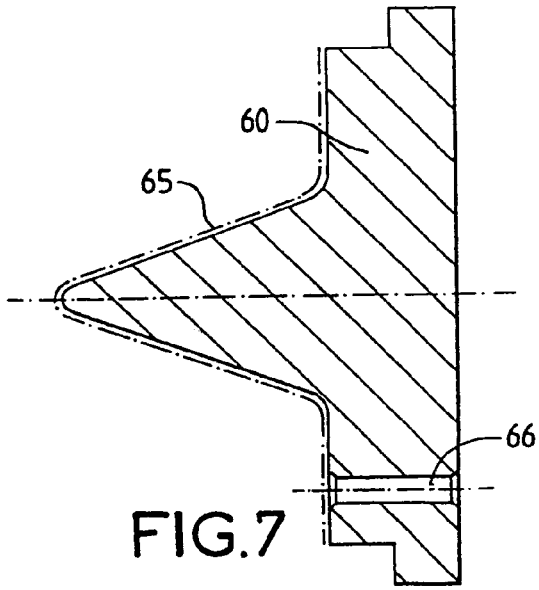

FIG. 7 shows just the fourth electrode 60 with its local surface conductive ceramic layer 65 and its drillhole 66 for a conducting feedthrough.

Figure 8:
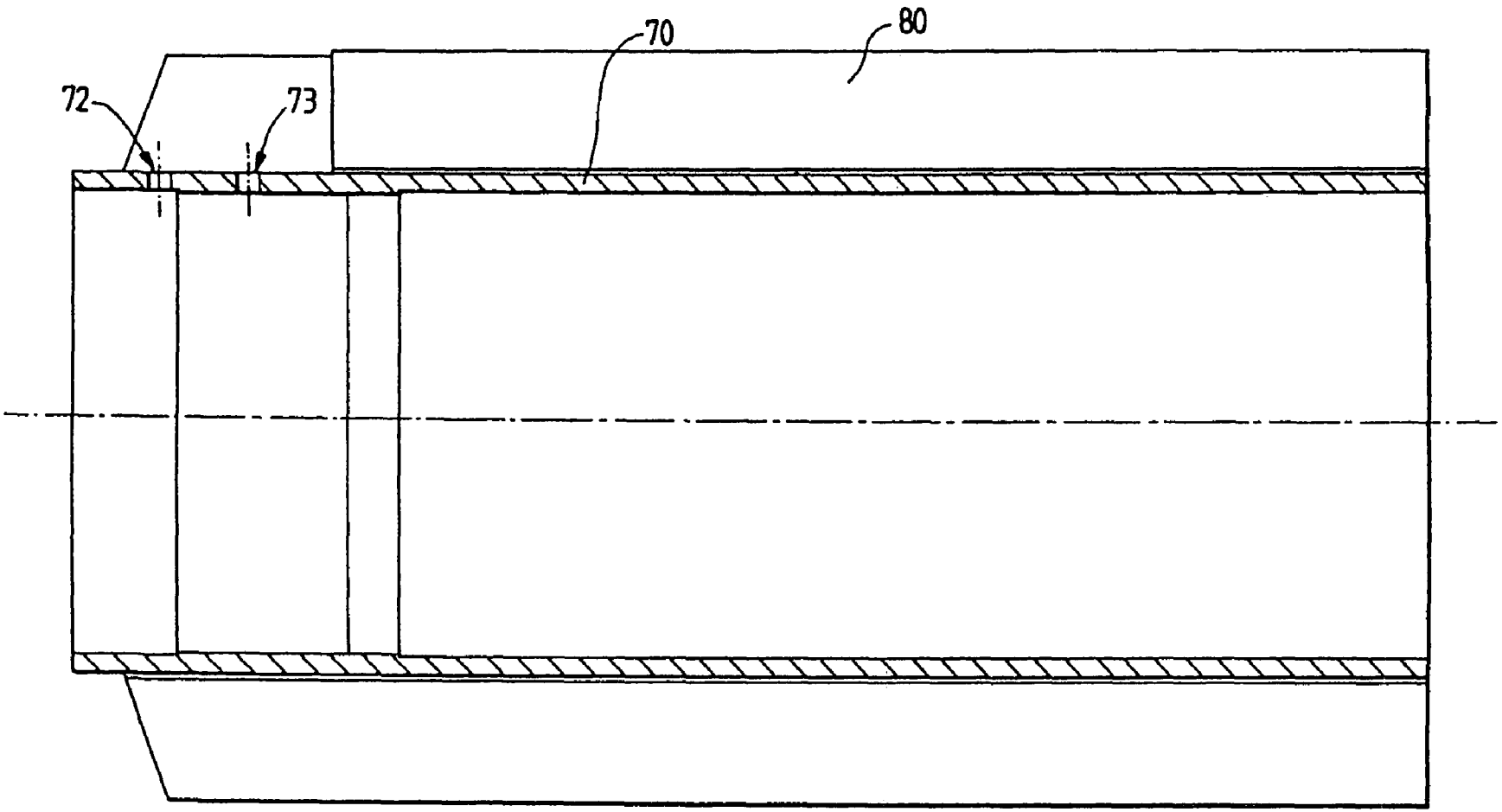
FIG. 8 shows the ceramic sheath intended to enclose the various electrodes.

FIG. 8 shows just the cylindrical sheath 70, with its radial fins 80. Drillholes 72 and 73 may be seen in the sheath, which face the drillholes 36 and 46 in the first and second electrodes 30 and 40 when these are mounted in the sheath, in order to let the conducting rods 32 and 42 pass through them. In fact, the conducting rods in this case pass through not only the thickness of the blocks of insulating ceramic that constitute the electrodes 30 and 40, but also the thickness of the sheath 70. There are no fins at a point where the drillholes 72 and 73 are, so that the conducting rods that will be placed in the drillholes are accessible. The drillholes 72, 73, 36 and 46 serve at the same time for correctly positioning the ceramic electrodes in the sheath 70.

The various constituent elements of the collector (electrodes and sheath) may be produced using conventional ceramic techniques. Preferably, the sheath 70 with its fins 80 is produced, owing to the fact that it is cylindrical, by extruding a green ceramic paste. The fins may have a grooved surface (grooves also being produced during extrusion) in order to improve the heat dissipation. The shaping of the sheath may be completed by other machining and drilling operations carried out on the green ceramic paste.

The electrodes are preferably produced by extrusion, followed by machining of these blocks in order to give them the desired shape (in the form of a cone with an opening at the apex and shoulders that facilitate their installation in the sheath). The blocks of green electrically insulating ceramic are coated with a slip of green electrically conductive ceramic. Alternatively, they could be coated with a conductive ink based on a refractory metal (especially tungsten).

The electrodes shown in the figures have conducting parts that are axisymmetric. However, it is possible to provide any pattern of conducting region without particular difficulty, although the machining of the metal blocks into unsymmetrical shapes would pose many more of the problems in the prior art.

This arrangement makes it possible to limit the reflected electrons by creating a dissymmetry in the electric field applied by the electrode thus formed, while maintaining an axisymmetric electrode that is simple to manufacture.

The blocks of green composite ceramic that are coated with an electrically conductive layer are inserted into the sheath, the rods of the conducting feedthroughs are fitted, and a conductive paste (made of ceramic or a conductive tungsten ink) may be deposited, for example using a brush, on the ends of these rods in order to make it easier for these rods to be electrically connected to the conducting surfaces of the electrodes.

Likewise, a conductive tungsten ink or a conductive ceramic paste may be deposited on the inside of the sheath, by brushing and/or dipping and/or spraying or sputtering, in order to produce the conductive surface depicted by the line 90 in FIG. 3. A conductive film may also be deposited on the outside of the sheath (without establishing an electrical connection with the surfaces inside the tube) in order to provide the collector with electromagnetic screens.

The final electrode 60, which forms the end wall of the tube, is fitted, with its conducting rod 62, after these operations.

The assembly comprising the electrodes, the sheath and the conducting rods is cosintered so as to result in the desired collector structure.

Figure 9:
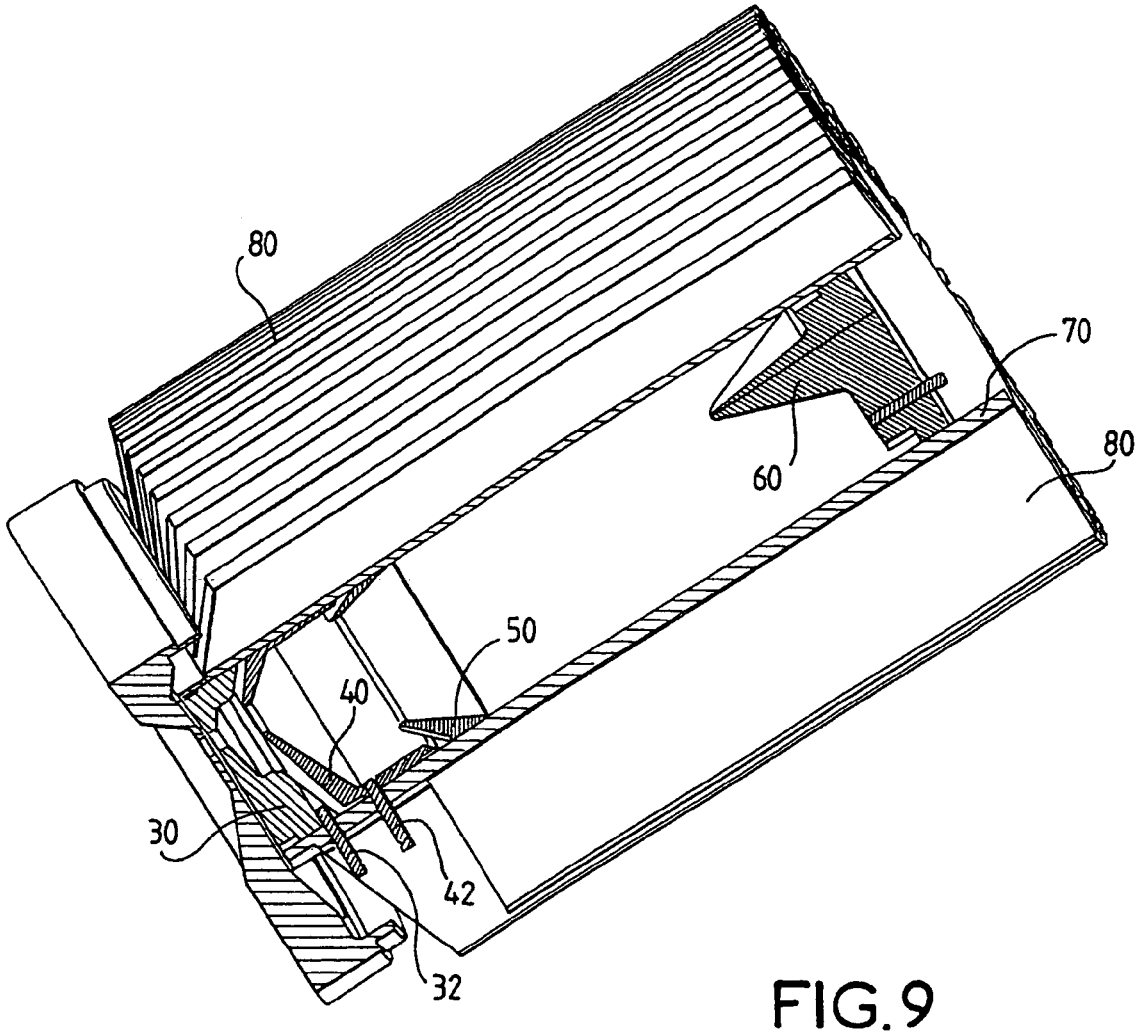
FIG. 9 shows, in perspective and in partial section, the mounted collector.

FIG. 9 shows, in a partially open view, the collector block thus produced. In its preferred version, all the electrodes and the sheath are made of ceramic that is conductive at least on the surface.

The preferred ceramic for all the insulating parts is preferably based on aluminium nitride AlN (up to 100%). The thermal conductivity of aluminium nitride is about 180 watts/m·K. A small proportion of silicon carbide SiC or titanium nitride TiN may be mixed with the aluminium nitride. Sintering additives in small proportion (less than 10%) may be included in the green ceramic paste in order to facilitate the sintering or cosintering with other ceramics.

As regards the electrical conducting parts of the electrode, the ceramic is preferably made of titanium nitride TiN, but it may also be made of titanium carbide TiC, tungsten carbide WC or silicon carbide SiC. These materials may be mixed with aluminium nitride. If the conducting surface parts are metallic, the metal is preferably tungsten or molybdenum. Here again, sintering additives may advantageously be provided, especially for facilitating the cosintering with aluminium nitride.

The particle size of the powders used to produce the ceramics may be used to vary the texture of the conducting surface of the electrode, a controlled particle size of around 1 micron (0.5 to 2 microns) resulting in the formation of surface microcavities tending to limit secondary electron emission when the electrode is bombarded by electrons.

The conducting rods constituting the feedthroughs in the insulating ceramics may be made of titanium nitride, titanium carbide or silicon carbide, or a mixture of these materials.

Here again, sintering additives may be provided. The rods may also be made of tungsten or molybdenum.

The sintering additives may typically be yttrium oxide $Y_2O_3$, calcium oxide CaO, yttrium fluoride $YF_3$ or calcium fluoride $CaF_2$.

Aluminium nitride (an insulator) and titanium nitride (a conductor) have similar properties, in particular in terms of rates of densification during cosintering, resulting in a strong inorganic bond of the ionic-covalent type.

It is known that green ceramics undergo substantial shrinkage (of about 15 to 30%) during sintering. This shrinkage is of course taken into account when determining the machining of the green ceramic parts. This shrinkage is used to advantage for ensuring bonding (with a radially inward bonding force) of the sheath onto the electrodes during the sintering operation.

The electrode assemblies thus produced may withstand very high operating temperatures without causing outgassing phenomena, as on metal electrodes of the prior art.

As regards the sheath, it should be pointed out that the invention may help the tube to be cooled by a fluid (and especially a liquid such as an electrically insulating oil or deionized water) if channels produced during the extrusion of the sheath are provided in the body of the sheath.

Indeed, in the prior art, the fluid should possess a dielectric strength sufficient to put up with external faces of the electrodes and of the outer envelope that are subjected to different voltages.

In the invention, the structure of the ceramic outer envelope may advantageously be penetrated in the longitudinal direction by capillaries, through which a cooling fluid may be circulated. Apart from the closeness of the cooling fluid to the internal surfaces to be cooled, this arrangement allows a standard fluid, such as water, to be used, since the fluid is no longer directly in contact with the electrodes. The fluid is in direct contact with the envelope over its entire length.

This novel arrangement also prevents the appearance of a galvanic couple, or chemical corrosion, since aluminium nitride is particularly inert chemically.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. A vacuum tube, comprising:

at least one electrode having an electrically conductive external surface, said electrode comprising a block of electrically insulating ceramic having a high thermal conductivity, which is coated at least in part with a superficially deposited thin layer of conductive material forming said electrically conductive external surface, wherein the vacuum tube includes, for connecting the electrode to the outside of the tube, a rod made of conductive ceramic in contact from one side with a conducting part of the electrode, on the inside of the tube, and passing through an insulating ceramic forming part of the electrode and/or of an insulating envelope of the tube, and cosintered with this insulating ceramic.

2. A process for manufacturing a vacuum tube, wherein the process comprises the production of at least one electrode made of a composite ceramic for the tube, including sintering a green layer of an electrically conductive ceramic on a green block of an electrically insulating ceramic having a high thermal conductivity.

3. The process according to claim 2, wherein the conductive ceramic is deposited as a thin layer on part of the surface of the insulating ceramic.

4. A process according to claim 2, wherein the insulating ceramic is based on aluminum nitride.

5. A process according to claim 4, wherein the surface layer of the electrically conductive ceramic is made of at least one of a group consisting of titanium nitride, titanium carbide, silicon carbide, and tungsten carbide.

6. A process according to claim 2, wherein the surface layer of the electrically conductive ceramic is made of at least one of a group consisting of titanium nitride, titanium carbide, silicon carbide, and tungsten carbide.

7. A vacuum tube, comprising: at least one electrode having an electrically conductive external surface, said electrode comprising a block of electrically insulating ceramic having a high thermal conductivity, which is coated at least in part with a superficially deposited thin layer of conductive material forming said electrically conductive external surface, wherein the block of ceramic has a thermal conductivity of at least 100 watts/m·K at 20° C. and wherein it includes, for connecting the electrode to the outside of the tube, a rod made of conductive ceramic in contact from one side with a conducting part of the electrode, on the inside of the tube, and passing through an insulating ceramic forming part of the electrode and/or of an insulating envelope of the tube, and cosintered with this insulating ceramic.

8. The tube according to claim 7 wherein the insulating ceramic is mainly based on aluminum nitride.

9. A vacuum tube, comprising:

at least one electrode having an electrically conductive external surface, said electrode comprising a block of electrically insulating ceramic having a high thermal conductivity, which is cosintered with a thin surface layer of electrically conductive ceramic forming said electrically conductive external surface; and a rod connecting the electrode to the outside of the tube, the rod made of conductive ceramic in contact from one side with a conducting part of the electrode, on the inside of the tube, and passing through an insulating ceramic forming part of the electrode and/or of an insulating envelope of the tube, and cosintered with this insulating ceramic.

10. The tube according to claim 9, wherein the thin surface layer of ceramic is based on titanium nitride or titanium carbide or silicon carbide or tungsten carbide, or a mixture of at least of these materials.

11. A vacuum tube, comprising:

at least one electrode having an electrically conductive external surface, wherein said electrode is formed entirely of a block of electrically insulating ceramic having a high thermal conductivity, the electrode coated at least in part with a superficially deposited thin layer of conductive material made of tungsten or molybdenum forming said electrically conductive external surface; and a rod connecting the electrode to the outside of the tube, the rod made of conductive ceramic in contact from one side with a conducting part of the electrode, on the inside of the tube, and passing through an insulating ceramic forming part of the electrode and/or of an insulating envelope of the tube, and cosintered with this insulating ceramic.

* * * * *